US005092975A

United States Patent [19]

Yamamura et al.

[11] Patent Number: 5,092,975

[45] Date of Patent: Mar. 3, 1992

[54] METAL PLATING APPARATUS

[75] Inventors: Takayoshi Yamamura; Yoshihisa Endo; Akira Shinmura, all of Hamamatsu, Japan

[73] Assignee: Yamaha Corporation, Japan

[21] Appl. No.: 366,783

[22] Filed: Jun. 15, 1989

[30] Foreign Application Priority Data

Jun. 14, 1988 [JP] Japan ..... 63-146331
Jul. 12, 1988 [JP] Japan ..... 63-172923

[51] Int. Cl.[5] ..... C25D 17/00

[52] U.S. Cl. ..... 204/198; 204/200; 204/201; 204/225

[58] Field of Search ..... 204/199, 200, 225, 274–278, 204/269, 297 R, 201; 118/423, 428, 425, 426, 429; 427/430.1

[56] References Cited

U.S. PATENT DOCUMENTS

| | | | |
|---|---|---|---|
| 1,772,074 | 8/1930 | Engelhardt et al. | 204/225 |
| 3,024,184 | 3/1962 | Bowes, Jr. et al. | 204/199 X |
| 3,062,225 | 11/1962 | Mans | 204/199 X |
| 3,381,695 | 5/1968 | Clark | 204/198 X |
| 3,382,844 | 5/1968 | Kumpf | 118/425 X |
| 3,417,008 | 12/1968 | Koltuniak | 204/225 |
| 3,500,979 | 3/1970 | Hammer | 118/425 X |
| 4,295,444 | 10/1981 | Hatta et al. | 118/425 X |

FOREIGN PATENT DOCUMENTS

| | | | |
|---|---|---|---|
| 645064 | 7/1962 | Canada | 204/200 |
| 524610 | 4/1955 | Italy | 204/200 |
| 365920 | 1/1963 | Switzerland | 204/200 |

*Primary Examiner*—Donald R. Valentine
*Attorney, Agent, or Firm*—Lerner, David, Littenberg, Krumholz & Mentlik

[57] ABSTRACT

In arrangement of high speed plating system, a number of sequential treatment bath units are arranged side by side along an arcuate path at equal intervals, a rotatable transfer unit of workpieces is arranged at the center of the arcuate path to concurrently allocate different workpieces to different treatment bath units for different but concurrent treatments and loading and unloading units are annexed to the transfer unit as interfaces to adjacent systems in a continuous line of production. Arcuate arrangement of the treatment bath units well minimized space demand in a mill and use of the loading and unloading units assure easy and smooth combination of the plating system with adjacent systems.

14 Claims, 18 Drawing Sheets

METAL PLATING APPARATUS

BACKGROUND OF THE INVENTION

The present invention relates to an improved metal plating method and apparatus, and more particularly relates to improvements in high speed metal plating system in which application of large current at low voltage causes relative movement between electrolyte and a workpiece to destroy an ion diffusion layer on the surface of the workpiece.

Such a conventional high speed metal plating system generally includes a pretreatment unit, a metal plating unit and an aftertreatment unit which are arranged one after another along a straight path. The system is further provided with a transfer unit which transfers workpieces through each unit and form units to unit. Each workpiece is loaded to the system at a supply port of the pretreatment unit for travel through various treatment baths in the unit being carried by the transfer unit. On arrival at the metal plating unit, the workpiece is accommodated in a metal plating bath in the unit. Under application of large current at high voltage, the bath, i.e. the electrolyte, is forced to flow at a high speed for plating of the workpiece. Next, the plated workpiece is passed through various treatment baths in the aftertreatment unit for final unloading at a discharge port of the aftertreatment unit.

Since the processing speed of the system is freely adjustable, the system can be well incorporated into a continuous line of production. Despite this advantage, the straight arrangement of the three units requires reservation of a large spacing in the continuous line of production. Further, in the case of the conventional high speed metal plating system, no special expedients are taken into consideration for efficient transfer of workpieces between the system itself and associated systems. Thus the production efficiency of the entire production line is ill influenced by presence of such a neck of transfer between the associated systems.

SUMMARY OF THE INVENTION

It is the object of the present invention to provide a high speed metal plating system which requires a reduced space for installation, in particular in a continuous line of production.

It is another object of the present invention to provide a high speed metal plating system which assures smooth and efficient transfer of workpieces between associated systems.

In accordance with the basic aspect of the present invention, a plurality of treatment bath units are arranged along an arcuate path, a transfer unit is arranged at the center of the arcuate path in an arrangement rotatable about the center and vertically shiftable, a loading unit is arranged facing the transferunit near one end of the arcuate path and an unloading unit is arranged facing the transfer unit near the other end of the arcuate path.

DESCRIPTION OF THE PREFERRED EMBODIMENTS

Figure 1:
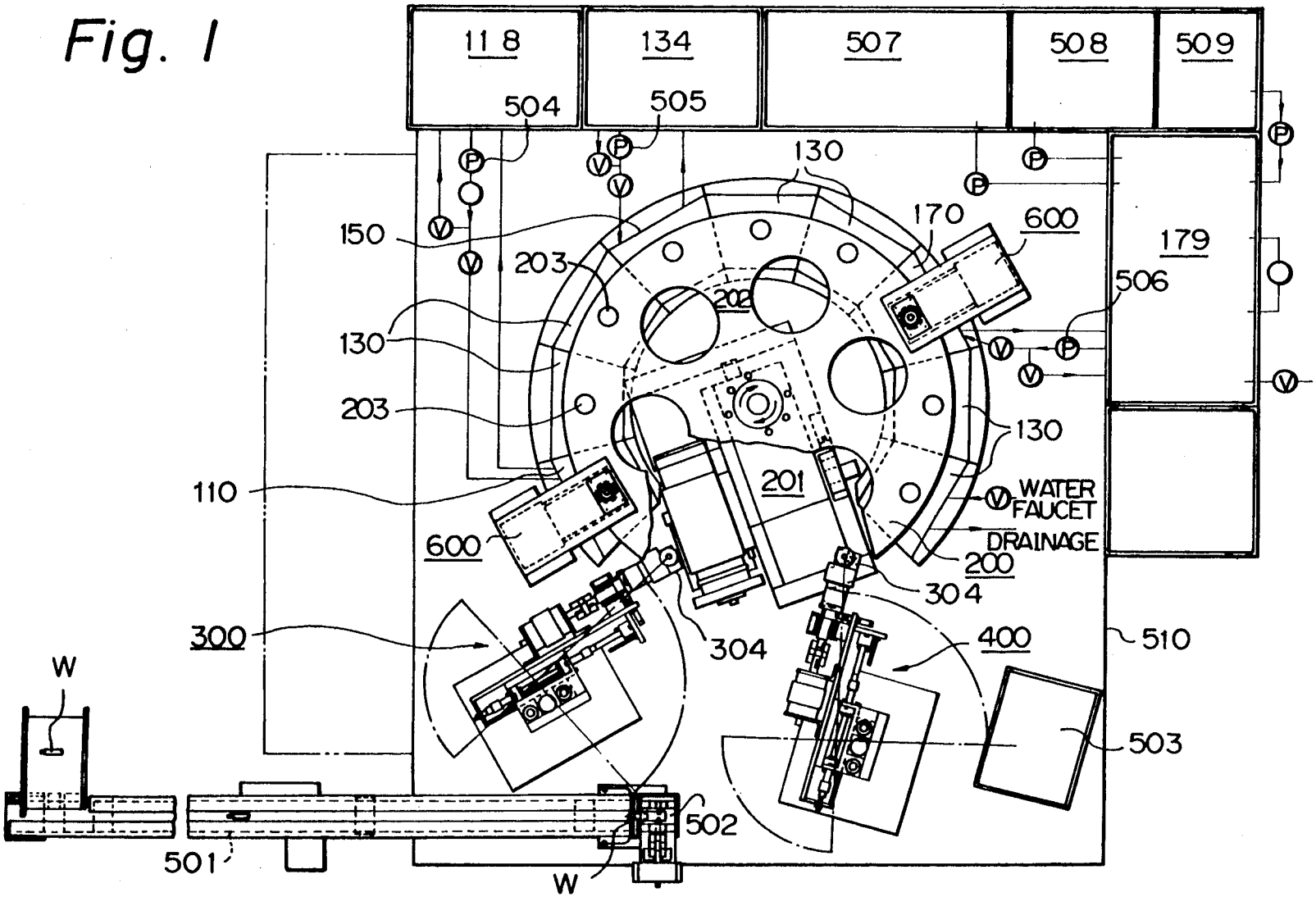
FIG. 1 is a plan view of the entire construction of one embodiment of the apparatus in accordance with the present invention.
Figure 2:
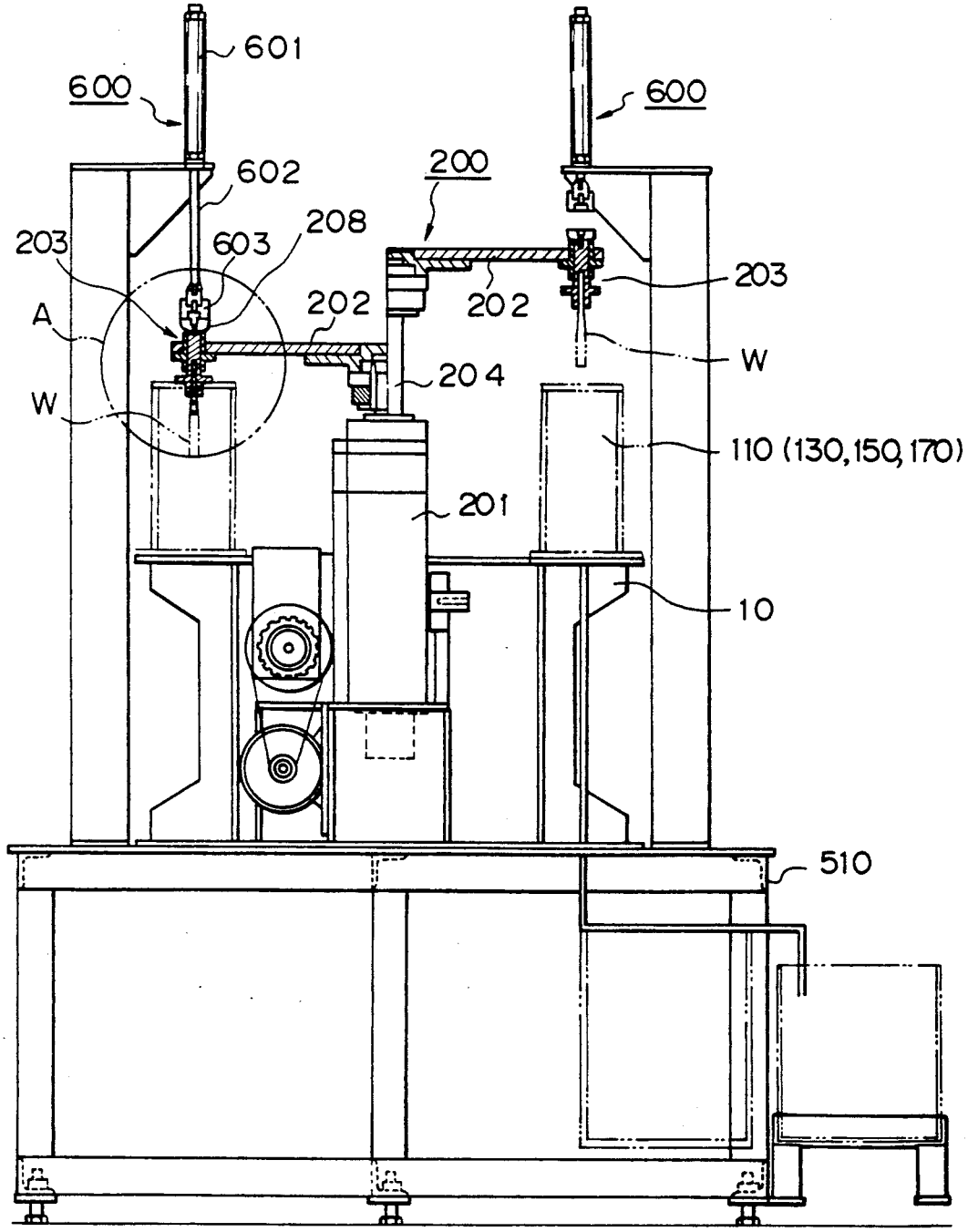
FIG. 2 is a front view of the apparatus shown in FIG. 1.

The entire construction of one typical embodiment of the apparatus in accordance with the present invention is shown in FIGS. 1 and 2, in which the apparatus includes various treatment bath units, i.e. electrolytic defat bath units 110, rinsing bath units 130, pickling bath units 150 and a plating bath unit 170. The apparatus further includes a transfer unit 200 for transferring workpieces W from bath unit to bath unit, a loading unit 300 for supplying crude workpieces W to the apparatus and an unloading unit 400 for discharging plated workpieces W from the apparatus, in most cases for assignment to a next associated system.

In the case of the illustrated embodiment, nine treatment bath units 110 to 170 are arranged around the transfer unit 200 along an arcuate path. The arcuate path is divided into twelve equal sections into which the treatment bath units are individually allotted. Each treatment bath unit is substantially trapezoid in its horizontal configuration so that sides of adjacent treatment bath unit should face to each other on the arcuate path. Nine of the equal sections accommodate the treatment bath units and remaining three sections accommodate the loading and unloading units 300 and 400, respectively. As best seen in FIG. 2, the nine treatment bath units are mounted to a pedestal 10.

Figure 3:
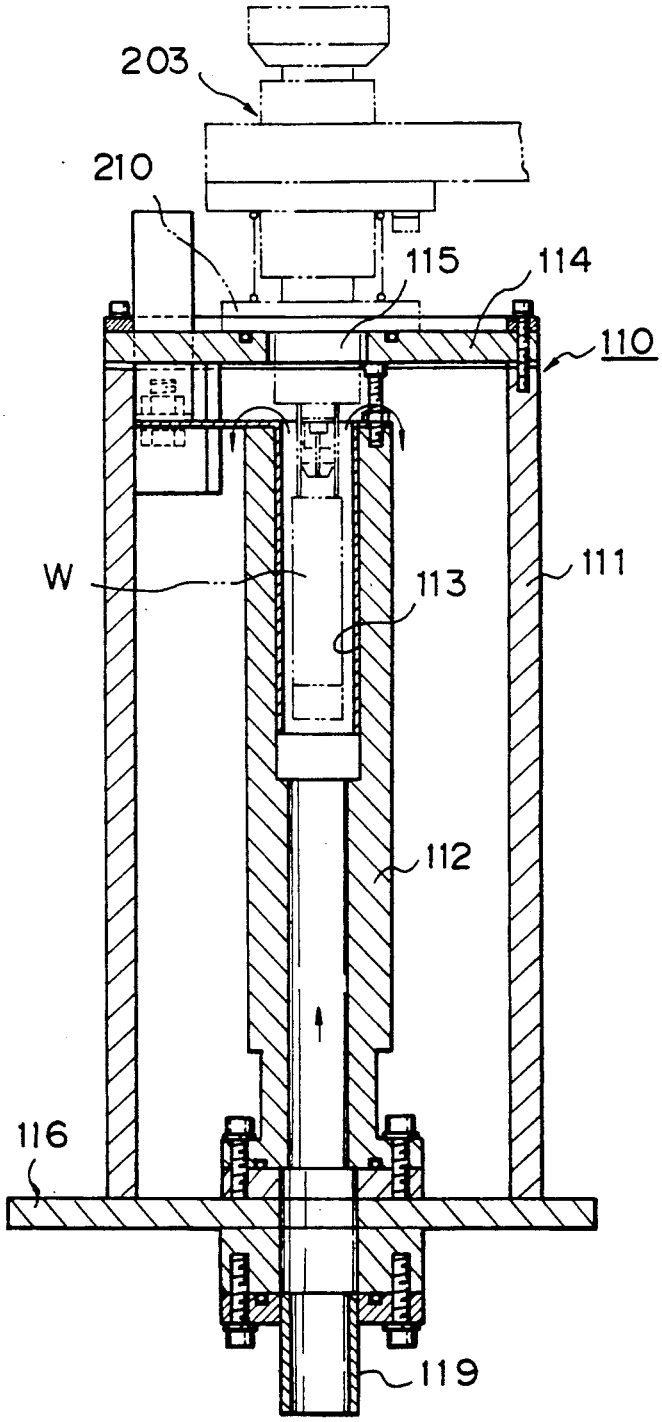
FIG. 3 is one sectional side view of one embodiment of an electrolytic defat bath unit used for the apparatus shown in FIG. 1.
Figure 4:
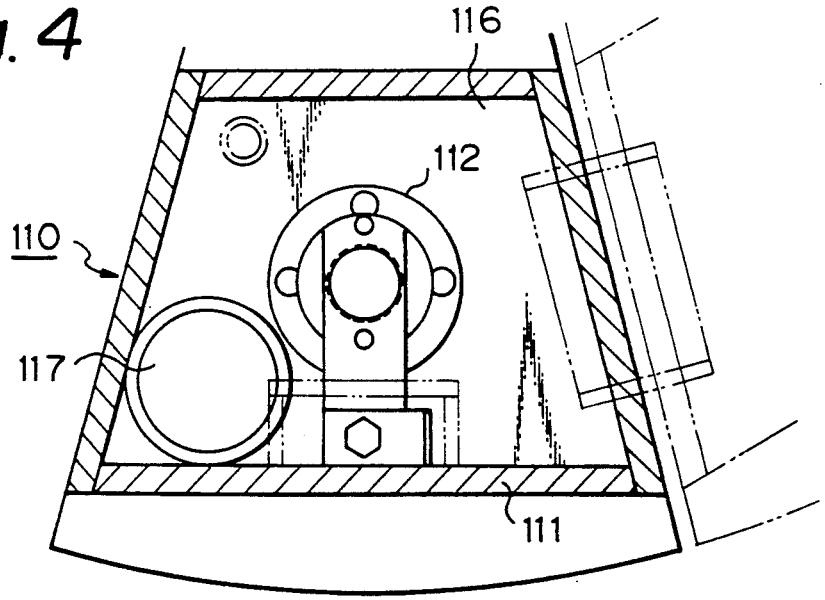
FIG. 4 is a sectional plan view of the defat bath unit.
Figure 5:
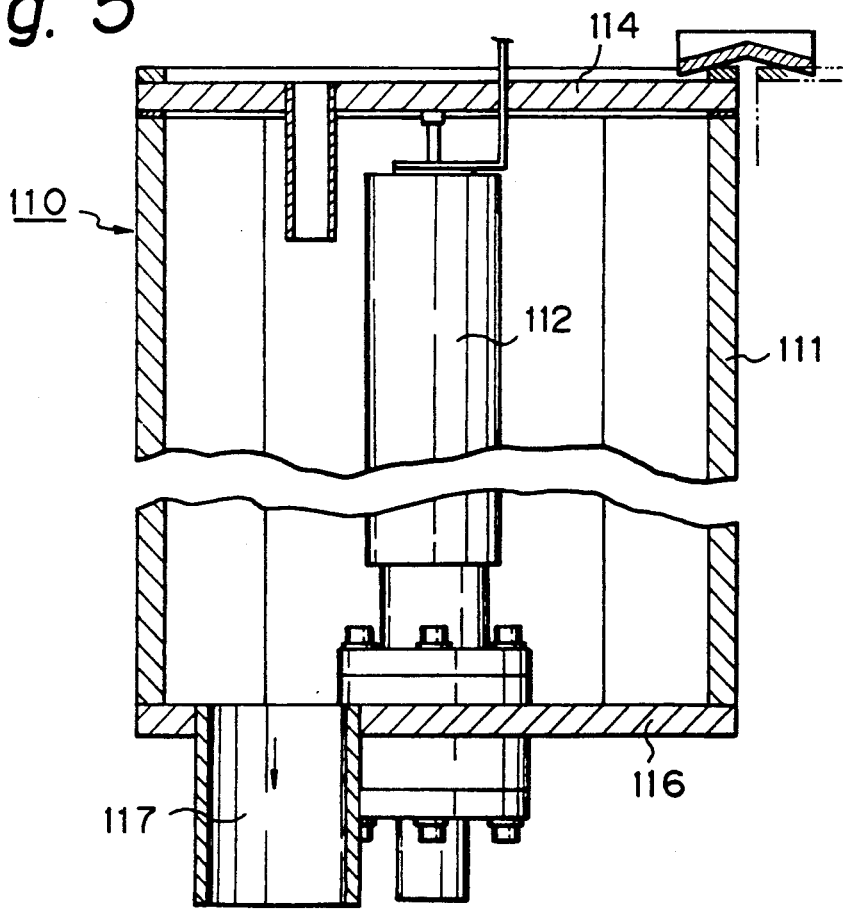
FIG. 5 is another sectional side view of the defat bath unit.
Figure 6:
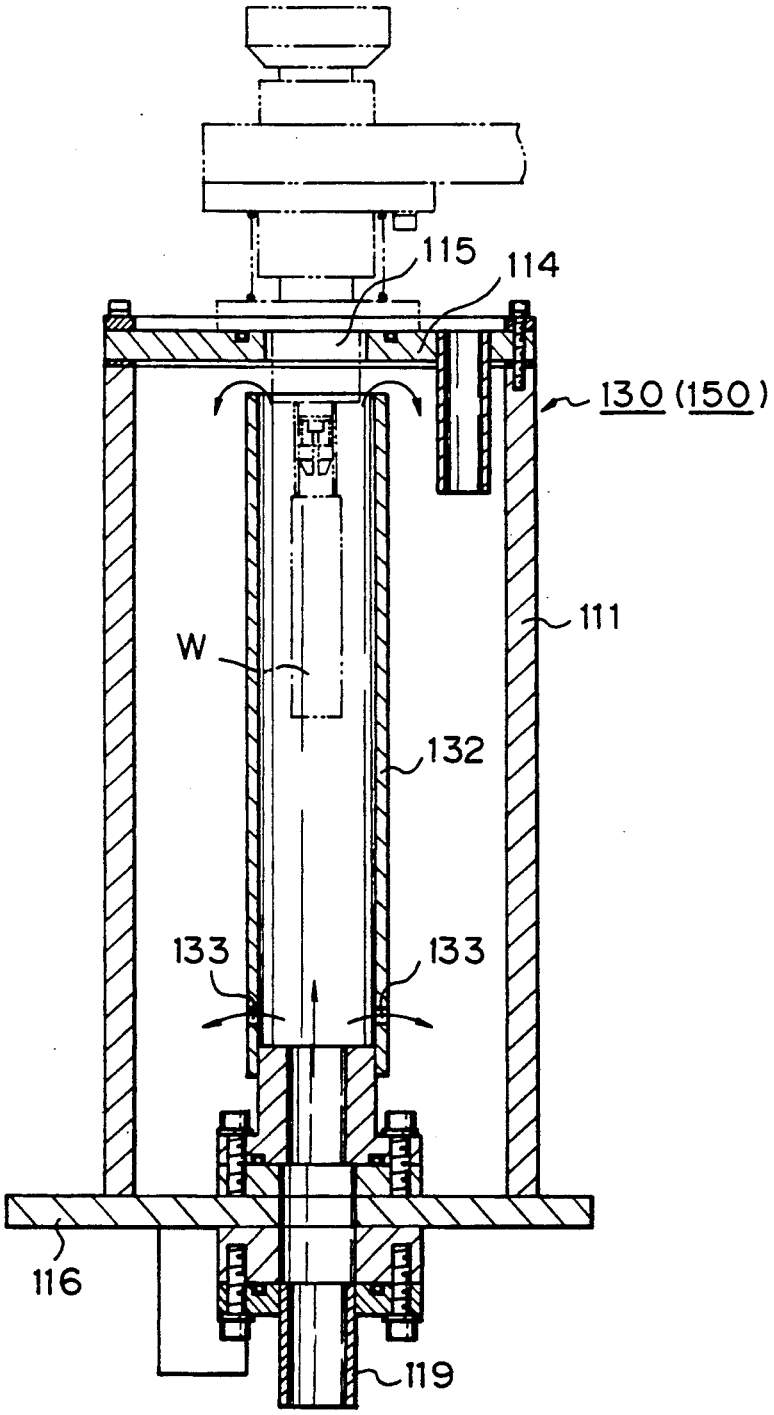
FIG. 6 is one sectional side view of one embodiment of a rinsing bath unit used for the apparatus shown in FIG. 1.
Figure 7:
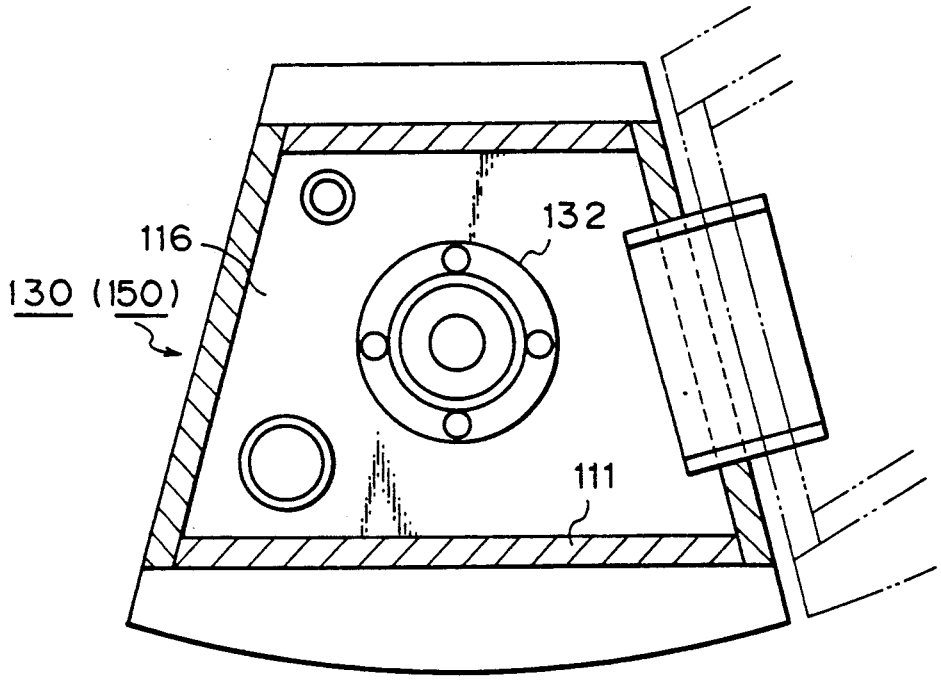
FIG. 7 is a sectional plan view of the rinsing bath unit.
Figure 8:
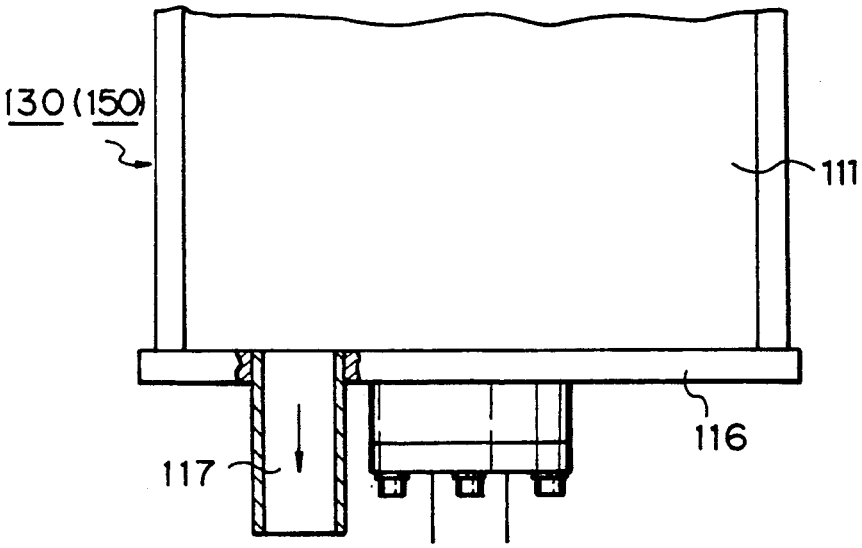
FIG. 8 is another sectional side view of the rinsing bath unit.

The defat bath unit 110 is used for removal of fat on workpieces W. As shown in FIGS. 3 to 5, the defat bath unit 110 is made up of an outer casing 111, an inner cylinder 112 and an electrode 113. The outer casing 111 is trapezoid in its horizontal configuration. The top end of the outer casing 111 is closed by a top closure 114 which is provided with an opening 115 for insertion of a workpiece W. A bottom closure 116 of this outer casing 111 is provided with a drain 117. This drain 117 is connected to a reservoir 118 shown in FIG. 1 by means of a collector tube not shown. The inner cylinder 112 is mounted atop the bottom closure 116 in an arrangement such that its cavity should be positioned just below the opening 115 in the top closure 114. The top end of the inner cylinder 112 is somewhat spaced from the top closure 114 of the outer casing 111. Within the upper section of the cavity of the inner cylinder 112 is accommodated the electrode 113 which is made of, e.g. stainless steel. The inner cylinder 112 is provided at its bottom end with a joint 119 for acceptance of a supply tube extending from the reservoir 118.

The rinsing bath units 130 perform rinsing of the workpieces W before and after the plating whereas the pickling bath units 150 remove acid from the crude workpieces W before the plating. The constructions of these bath units 130 and 150 are very similar to those of the defat bath unit 110 shown in FIG. 3 and, for this reason, like elements are designated with like reference numerals. The rinsing bath unit 130 includes an outer casing 111 and an inner cylinder 132 encased in the former. Near the lower end, the inner cylinder 132 is provided with several radial openings 133. The lower end of the inner cylinder 132 is also provided with a joint 119 which is connected to a given water supply such as a water faucet. The drain 117 of the outer casing 111 connected to a given drain pipe. In the case of the pickling bath unit 150, the joint 119 is connected to a reservoir 134 of pickling agent and the drain 117 is connected to a collector tube extending from the reservoir 134.

Figure 9:
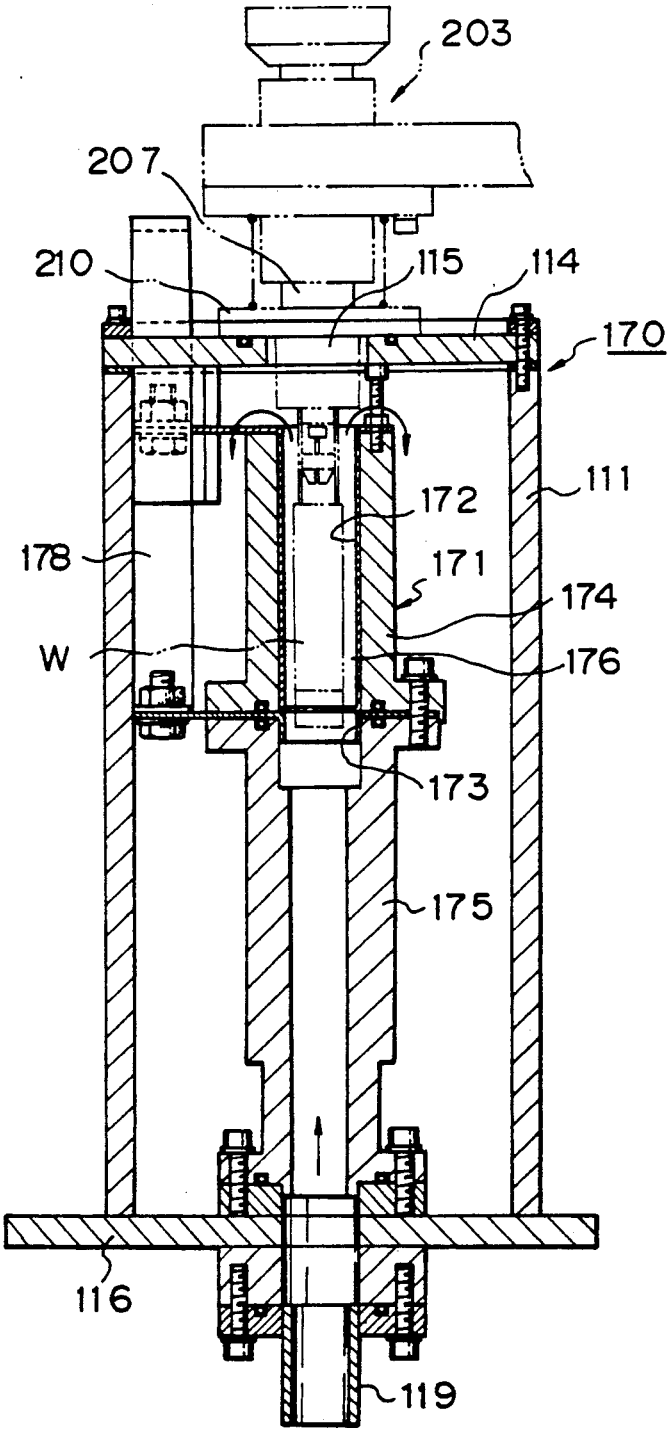
FIG. 9 is one sectional side view of one embodiment of the plating bath unit used for the apparatus shown in FIG. 1.
Figure 10:
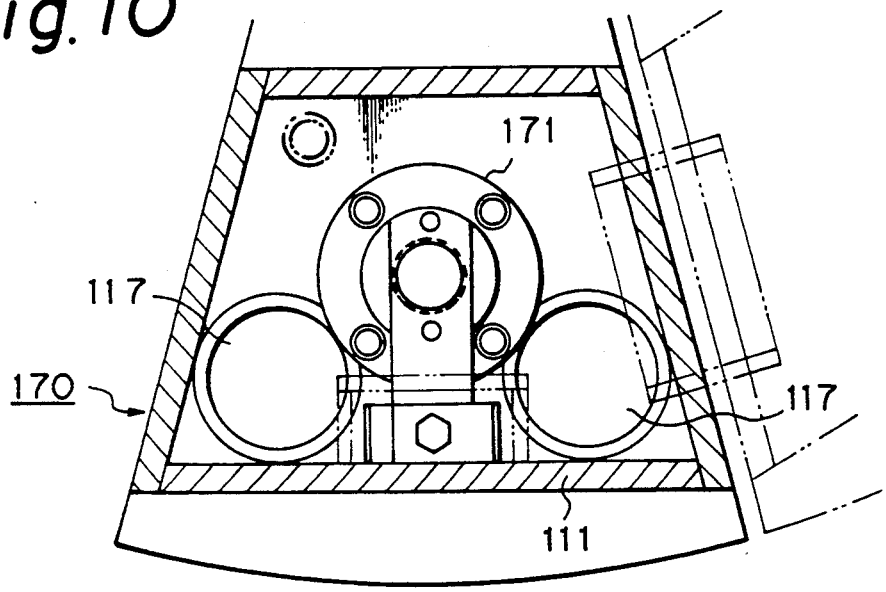
FIG. 10 is a sectional plan view of the plating bath unit.
Figure 11:
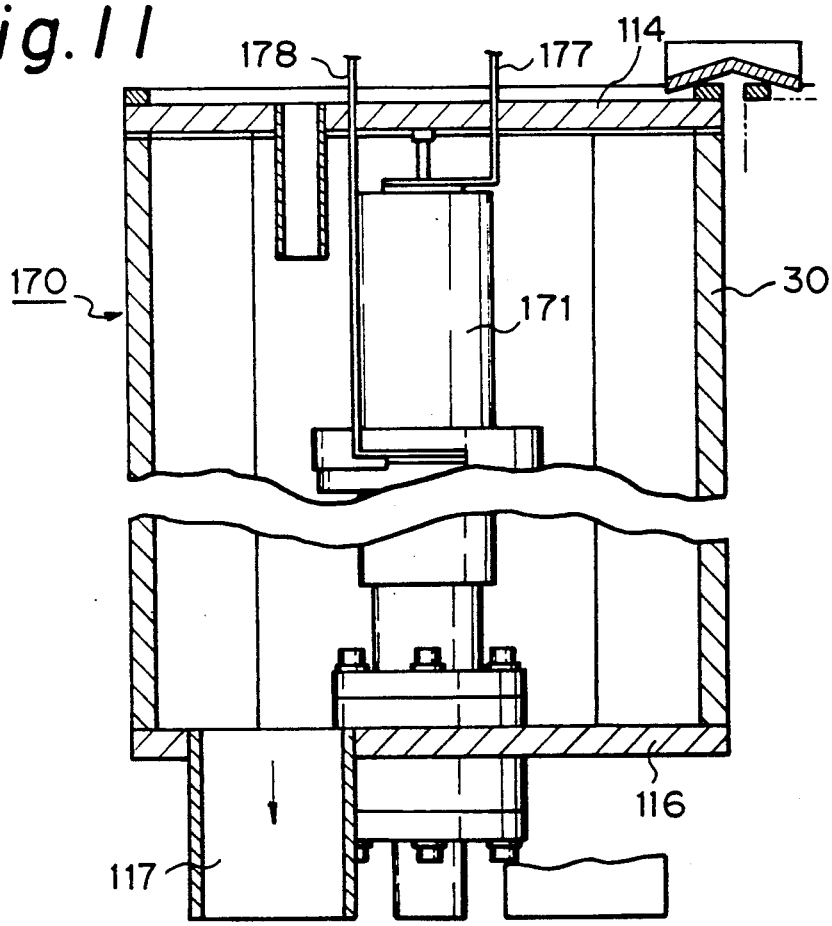
FIG. 11 is another sectional side view of the plating bath unit.

One embodiment of the plating bath unit 170 is shown in FIGS. 9 to 11, in which elements similar to those used for the preceding bath units are designated with similar reference numerals. The plating bath unit 170 is made up of an outer casing 111, a bath assembly, an upper electrode 172 and a lower electrode 173. The bath assembly 171 is made up of an upper cylinder 174 and a lower cylinder 175 secured to each other and mounted atop a bottom closure 116. The upper electrode 172 is inserted into the upper cylinder 174 whereas the lower electrode 173 is inserted into the lower cylinder 175 being somewhat spaced from the upper electrode 172. A plating bath 176 is formed whilst being surrounded by the upper and lower electrodes 172 and 173. Each electrodes is given in the form of a cylinder made of titanium and platinum plating of low electric resistance is applied to the surface of the electrode for protection against corrosion by the electrolyte and for better current flow. The inner diameter of the cylinder forming the electrode is chosed so that, when a workpiece W is inserted into the plating bath, the clearance between the electrode and the workpiece W should be 5.0 mm. or smaller. When the clearance exceeds this limit, the flow rate of the electrolyte is reduced to lower the plating speed. The electrodes 172 and 173 are connected to the positive pole of a given power source via conductors 177 and 178, respectively. A joint 119 is attached to the lower end of the lower cylinder 175 for connection with a supply tube extending from a reservoir 179 for the electrolyte. The drains 117 formed in the bottom closure 116 is connected to the reservoir 179 via collector tubes not shown.

The transfer unit 200 shown in FIGS . 1,2,12 and 17 is made up of a drive assembly 201, a rotary disc 202 and holder assemblies 203. The drive assembly 201 drives the rotary disc 202 for intermittent rotation each over a prescribed angle, each cover 30 degrees in this example, and for vertical shifting. The center of rotation of the rotary disc 202 falls on the center of the arcuate path along which the treatment bath units are arranged.

Figure 12:
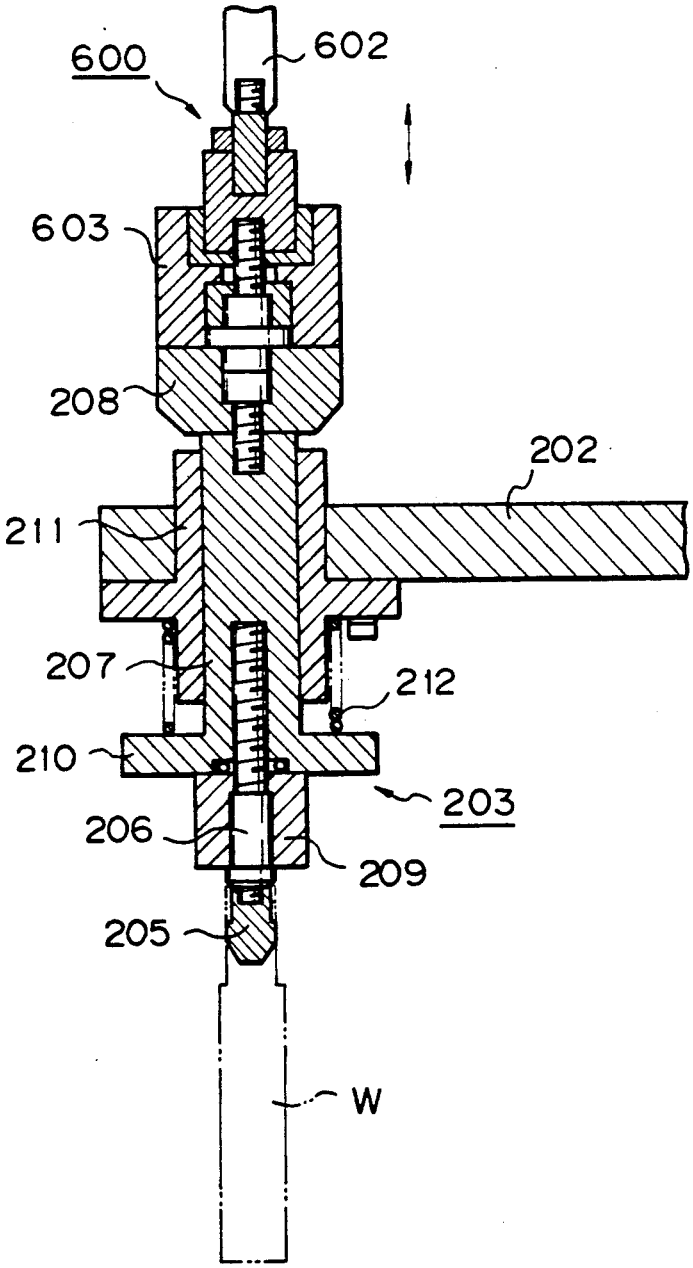
FIG. 12 is a sectional side view of one embodiment of the transfer unit used for the apparatus shown in FIG. 1, i.e. the section shown with a circle A in FIG. 2.

As best seen in FIG. 12, the rotary disc 202 holds the holder assemblies 203 and secured to a drive shaft 204 of the drive assembly 201. The rotary disc 202 is located at a lever above the treatment bath units.

The holder assembly 203 is used for holding the workpiece W and 12 sets of holder assemblies 203 are arranged along the periphery of the rotary disc 202 at an interval of 30 degrees. The distance of the holder assemblies 203 from the center of rotation of the rotary disc 202 is selected such that a circle formed by connecting the 12 holder assemblies 203 should coincide the one formed by connecting the openings 115 of the treatment bath units 110, 130, 150 and 170.

Each holder assembly 203 includes, as seen in FIG. 12, a brass head 205 to be tightly inserted into one end of the workpiece W to be held, a brass connecting rod 206 in screw engagement with the head 205, a brass shaft 207 in screw engagement with the connecting rod 206, a brass electric reception head 208 securely mounted atop the shaft 207 and a resin sleeve 209 embracing the lower end section of the connecting rod 206 to avoid plating thereof. The lower end of the shaft 207 is provided with an outer flange which forms a sealing closure 210 for closing the opening 115 of the treatment bath units. The rotary disc 202 is inserted over the shaft 207 via an insulating resin sleeve 211 in a vertically shiftable arrangement. A spring 212 is interposed between an outer flange of the insulating sleeve 211 and the sealing closure 210.

The loading unit 300 is adapted for supplying crude workpieces W to the transfer unit 200 and, as shown in FIG. 1, arranged near the defat bath unit 110. The unloading unit 400 is adapted for discharging plated workpieces W from the transfer unit 200 and arranged near the terminal rinsing bath unit 130 on the arcuate path.

Figure 13:
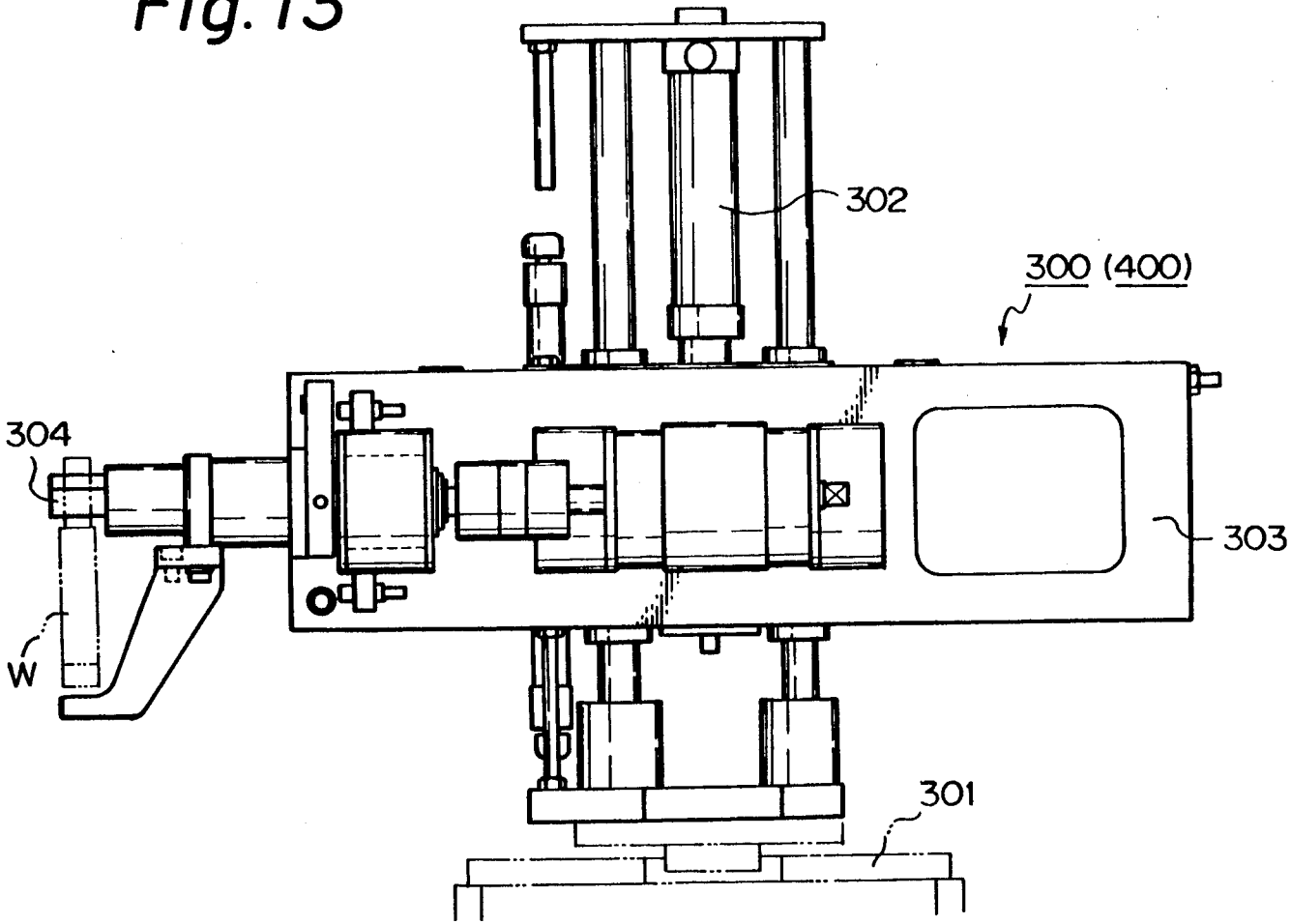
FIG. 13 is a front view of one embodiment of the loading or unloading unit used for the apparatus shown in FIG. 1.
Figure 14:
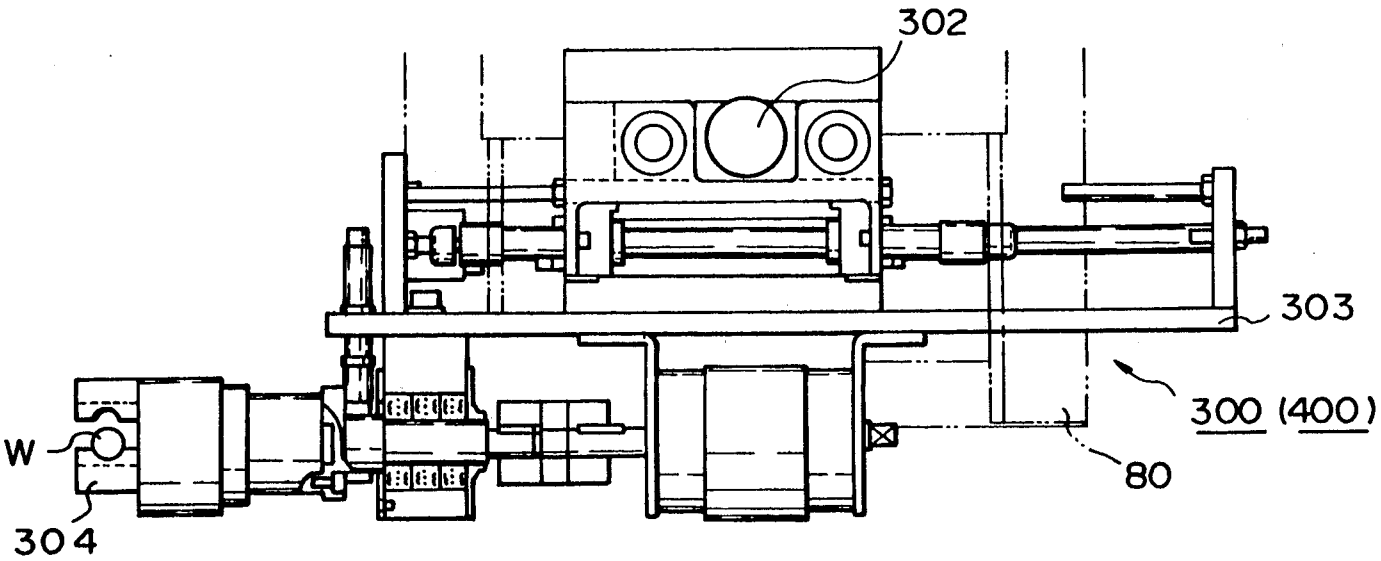
FIG. 14 is a plan view of the loading or unloading unit.
Figure 15:
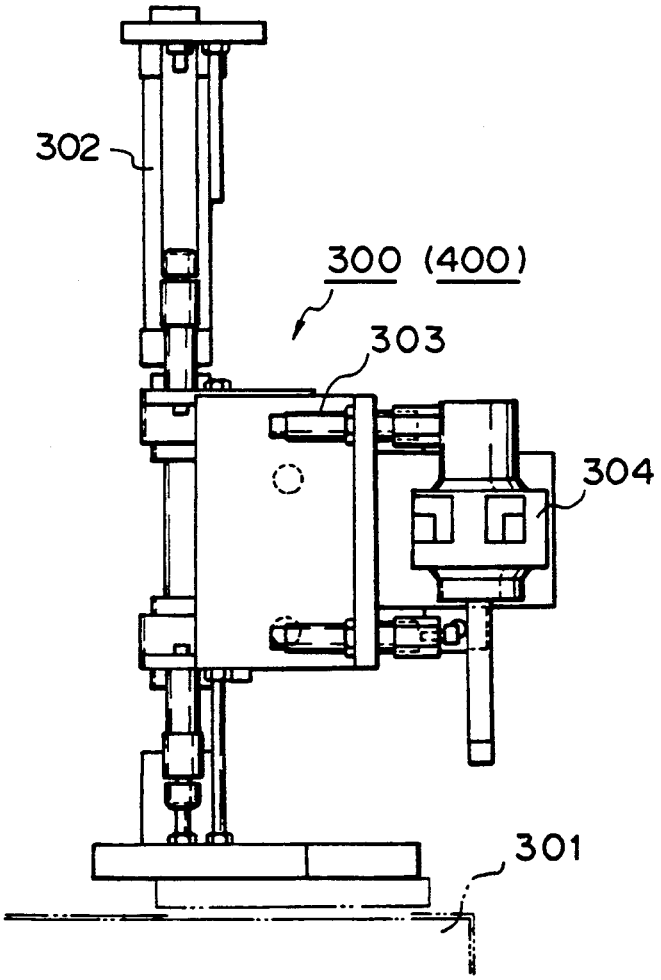
FIG. 15 is a side view of the loading or unloading unit.

As shown in FIGS. 13 to 15, each of the loading and unloading units includes rotary block 301 rotatable in a horizontal direction, a lifter block 302 mounted onto the rotary block 301, a mobile assembly 303 mounted to the lifter block 302 and a clamper 304 mounted to the mobile assembly 303 for clamping workpiece W.

Back to FIG. 1, a horizontal conveyer 501 is arranged on one side of the loading unit 300 and, at one end thereof closer to the loading unit 300, provided with a raising assembly 502 to raise workpieces W transported by the conveyer 501 upright for assignment to the loading unit 300. On one side of the unloading unit 400 remote from the loading unit is arranged a collector box 503 for receiving plated workpieces W.

Electric supply units 600 are arranged facing the defat and plating bath units 110 and 170 as shown in FIG. 1. In FIG. 2, each electric supply unit 600 includes a fluid cylinder 601 such as an air cylinder provided with a plunger 602 movable vertically and a copper electric supply head 603 coupled to the lower end of the plunger 602 via an insulator. The electric supply head 603 is connected to a give electric power source.

As shown in FIG. 1, the rinsing bath unit 130 is connected to a water faucet and a drainage whereas the defat bath unit 110 is accompanied with an agent supply unit composed of the 3 reservoir 118 and a pump 504. The reservoir 118 is a bath made of fiber reinforced plastics and about 20 l in capacity. The reservoir 118 is equipped with a proper electric heater and a thermometer so that the temperature of the accommodated agent should be maintained in a range from 50 to 60 degrees.

The pickling bath unit 150 is accompanied with an agent supply unit composed of the reservoir 134 and a pump 505. The reservoir 134 is a bath made of fiber reinforced plastics and about 20 l in capacity. The reservoir 134 is also equipped with a proper electric heater and a thermometer so that the temperature of the accommodated agent should be maintained in a range from 50 to 60 degrees.

The plating bath unit 170 is accompanied with an agent supply unit composed of the reservoir 179 and a pump 506. The reservoir 179 is a bath make of fiber reinforced plastics and about 40 l in capacity. The reservoir 179 is also equipped with a boiler and a thermometer so that the temperature of the accommodated electrolyte should be maintained in a range from 75 to 85 degrees. The plating bath unit 170 is connected to the first to third electrolyte baths 507 to 509. The first electrolyte bath 507 accommodates mixture of nickel sulfate, nickel chloride and boron acid, the second electrolyte bath 508 accommodates nickel carbonate used for PH adjustment, and the third electrolyte bath 509 accommodates luster. The reservoir 179 is equipped with an integrating ammeter, a PH meter and level meter so that electrolytes in the first to third electrolyte baths should be charged into the reservoir 179 when the composition and the quantity of the electrolyte in the reservoir 179 fall off the preset ranges. The reservoirs 118, 134 and 179, the first to third electrolyte baths 507 to 509 are arranged around a pedestal 510 of the plating apparatus.

Next the operation of the apparatus of the above-described construction will be explained.

Figure 16:
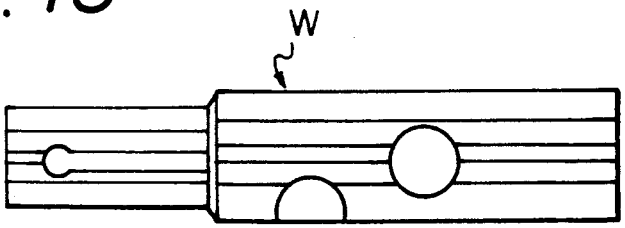
FIG. 16 is a front view of one example of the workpiece plated in accordance with the present invention.

Workpieces W from the preceding system in the continuous line of production are sequentially assigned at first onto the conveyer 501. One example of such a workpiece W is shown in FIG. 16 in which the workpiece W is a metallic tubular piston used for tubular musical instruments. At the end of the conveyer 501, each workpiece W is raised upright by operation of the raising assembly 502 for assignment to the loading unit 300.

Figure 17:
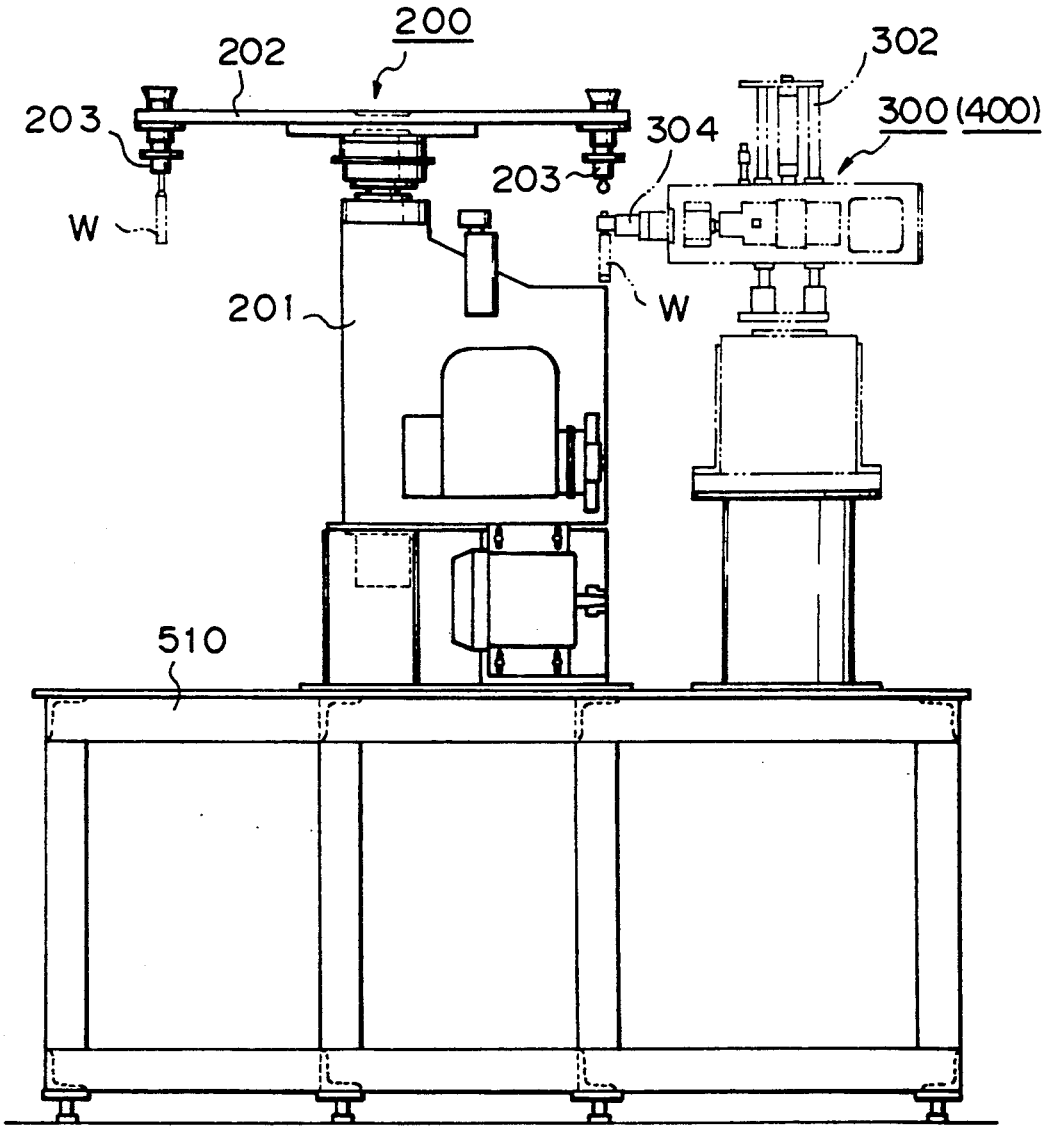
FIG. 17 is a side view of the transfer unit.

In this upright position, the workpiece W is held by the clamper 304 of the loading unit 300. The loading unit 300 then rotates as shown with a chain line in FIG. 1 in order to move the workpiece W to a position below the holder assembly 203 of the transfer unit 200 as shown in FIG. 17. As the clamper 304 of the loading unit 300 is moved upwards, the head 205 of the transfer unit 200 enters into the cavity of the workpiece W as shown in FIG. 12 in order to firmly hold the same. The transfer unit 200 then performs a 30 degree rotation and moves downwards in order to insert the workpiece W into the defat bath unit 110 passing through the opening 115 in the outer casing 111. At the same time the opening 115 is closed tightly by the sealing closure 210 of the holder assembly 203.

The defat agent is supplied into the defat bath unit 110 from the reservoir 118. The defat agent quickly flows upward through the inner cylinder 112 of the defat bath unit 110, flows downwards into the cavity of the outer casing 111 via the top end of the inner cylinder 112 and finally recollected back into the reservoir 118 via the drain 117.

After supply of the defat agent into the defat bath unit 110, the electrode 113 and the workpiece W are galvanized. Electric supply to the workpiece W is carried out via the holder assembly 203 of the transfer unit 200. That is, the electric supply head 603 of the electric supply unit 600 positioned above the defat bath unit 110 is moved downwards for contact with the electric reception head 208 of the holder assembly 203 as shown in FIG. 2. Since the head 208 is made of brass, the workpiece W can be galvanized.

After the treatment in the defat bath unit 110 is over, the rotary disc 202 of the transfer unit 200 is moved upwards in order to take out the workpiece W from the defat bath unit 110. Next, the rotary disc 202 is driven for rotation over 30 degrees in order to position the workpiece W above the rinsing bath unit 130 next to the defat bath unit 110. Thereafter the rotary disc 202 is moved again downwards in order to insert the workpiece W into the inner cylinder 132 of the rinsing bath unit 130. After this insertion of the workpiece W, rinsing water in jet is supplied from the water faucet into the inner cylinder 132. The rinsing water so supplied flows from the upper end of the inner cylinder 132 towards the bottom drain 117 for discharge therethrough.

After the rinsing operation is over, supply of the water into the inner cylinder 132 is ceased. Then the water remaining in the inner cylinder 132 is discharged outside through the radial openings 133 and the level in the inner cylinder 132 is lowered to rid the workpiece W of water.

Next the rotary disc 202 is moved upwards to take out the workpiece W from the rinsing bath unit 130. The rotary disc 202 is again rotated over 30 degrees and, subsequently, moved downwards to pass the workpiece W to the next rinsing bath unit 130 for further rinsing purposes. After treatment in this second rinsing bath unit 130, the workpiece W is assigned to the next pickling bath unit 150 by operation of the transfer unit 200.

Removal of acid on the workpiece W is performed in the pickling bath unit 150 by the agent supplied into the inner cylinder 132 from the reservoir 134. Operation in this pickling bath unit 150 is basically similar to those carried out in the preceding rinsing bath units 130 and, therefore, explanation thereof is here omitted.

After complete removal of acid, the workpiece W is assigned to the third and fourth rinsing bath units 130 for removal of the agent used for removal of acid.

After operation in the fourth rinsing bath unit 130, the workpiece W is passed into the plating bath 176 of the plating bath unit 170 as shown in FIG. 9 by a subsequent combination of an upward movement, a 30 degree rotation and a downward movement of the transfer unit 200. Thereupon the top opening 115 of the outer casing 111 is closed by the sealing closure 210 of the shaft 207 of the holder assembly 203.

After this closing, electrolyte is supplied into the plating bath 176 from the reservoir 179. The electrolyte so supplied overflows the top end of the plating bath 176 into the interior of the outer casing 111 and is recollected by the reservoir 179 via the drain 117. Preferably the electrolyte to be charged into the plating bath unit 170 should be maintained at a temperature of 70 degrees or higher.

A couple of seconds after supply of the electrolyte the electric supply head 603 of the electric supply unit 600 is moved downwards for contact with the electric reception head 208 of the holder assembly 203 and the workpiece W is galvanized. Depending on the length of the workpiece W, one or both of the electrodes 172 and 173 are used for the galvanization. There is, only the upper electrode 172 is used for a short length and the lower electrode 173 is also used when the workpiece W is long enough to extend beyond the lower end of the upper electrode 172.

After termination of the plating process, the electric supply head 603 of the electric supply unit 600 is moved upwards and the rotary disc 202 of the transfer unit 200 is again moved upwards in order to take out the workpiece W from the plating bath unit 170.

After the workpiece W is taken out of the plating bath unit 170, the rotary disc 202 of the transfer unit 200 is again rotated over 30 degrees and moved downwards to pass the workpiece W to the fifth and sixth rinsing bath units 130 for final rinsing. After taking out from the sixth rinsing bath unit 130, the rotary disc 202 of the transfer unit 200 is again rotated over 30 degrees to carry the workpiece W to the unloading station.

On arrival at the unloading station, the workpiece W is held by the clamper 304 of the unloading unit 400. Next by downward movement of the clamper 304 caused by operation of the lifter block 302 as shown in FIG. 17, the workpiece W is released from the head 205 of the holder assembly 203 for discharge into the collector box 503.

The foregoing explanation is directed to processing of a single workpiece W held by one holder assembly 203. In practice, however, a plurality of workpieces W are sequentially allotted to successive holder assemblies 203 for concurrent processing of these workpieces W.

Since a plurality of treatment bath units are arranged along an arcuate path in accordance with the present invention, lots of treatment baths can be accommodated in a limited space and, as a consequence, the apparatus is very compact in construction. The trapezoid horizontal configuration of each treatment bath unit is well suited for the collected arrangement of the units. The compactness of the apparatus is furthered by arrangement of the transfer unit 200 within the space surrounded by the plurality of treatment bath units. In other words, the space in a mill can be very efficiently utilized. In addition, presence of the loading and unloading units assures smooth connection with adjacent systems in a continuous line of production. Use of various reservoirs of agents enables free supply of agents at any time required, thereby allowing compact constructions of the treatment bath units. Further, in accordance with the present invention, treating agents are brought into contact with the workpieces by means of overflow to minimize the quantity of the agents necessary for these treatments. This greatly reduces plating cost of the workpieces W.

Presence of the radial openings in the inner cylinder 132 of each rising bath unit causes instant lowering in level of the water in the inner cylinder 132 after stop of water supply and, as a consequence, removal of water from the workpieces can be performed without lifting the workpieces W, thereby allowing reduced use of water for rinsing. Rinsing time can be shortened without any malign influence on plating time.

Use of the two electrodes arranged with difference in level allows free change in the galvanizing zone so that the apparatus can be used for processing workpieces of various length without change in original design. Holding of each workpiece by insertion of the head 205 enables contact of the entire outer surface of the workpiece with the electrolyte for full plating of the workpiece. Galvanization of the workpiece is initiated a little after start of electrolyte supply to start plating under a stable flow condition of the electrolyte for ideal plating effect.

Figure 18:
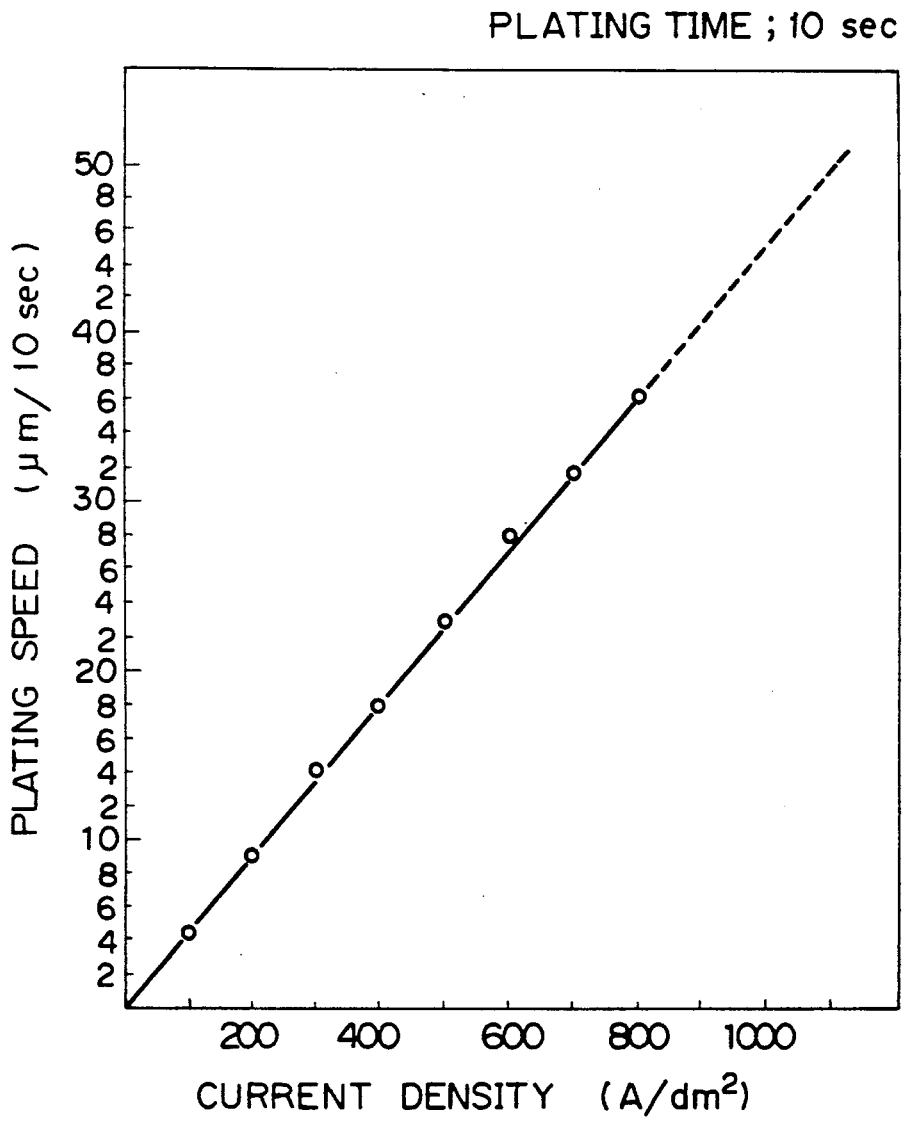
FIG. 18 is a graph for showing the relationship between the current density and the plating speed.

When high speed plating is carried out in accordance with the present invention, its plating speed is proportional to the current density employed as shown in FIG. 18, in which the current density in $A/dm^2$ is taken on the abscissa and the plating speed in $\mu m/10$ sec is taken on the ordinate. With a current density is a range from 250 to 1000 $A/dm^2$, plating can be carried out at a high speed in range from 1 to 4 $\mu m/sec$ or higher. It is clear that a large current density should be employed in order to carry out plating at a high speed. The maximum current density (I) is given by the following equation;

$$I=DnFC/\delta(1-\alpha) \quad (1)$$

In this equation, D is the diffusion coefficient of the salt added to the electrolyte. The larger the value of D, the higher the plating speed. The temperature of the electrolyte bath should be raised to enlarge the value of D.

Figure 19:
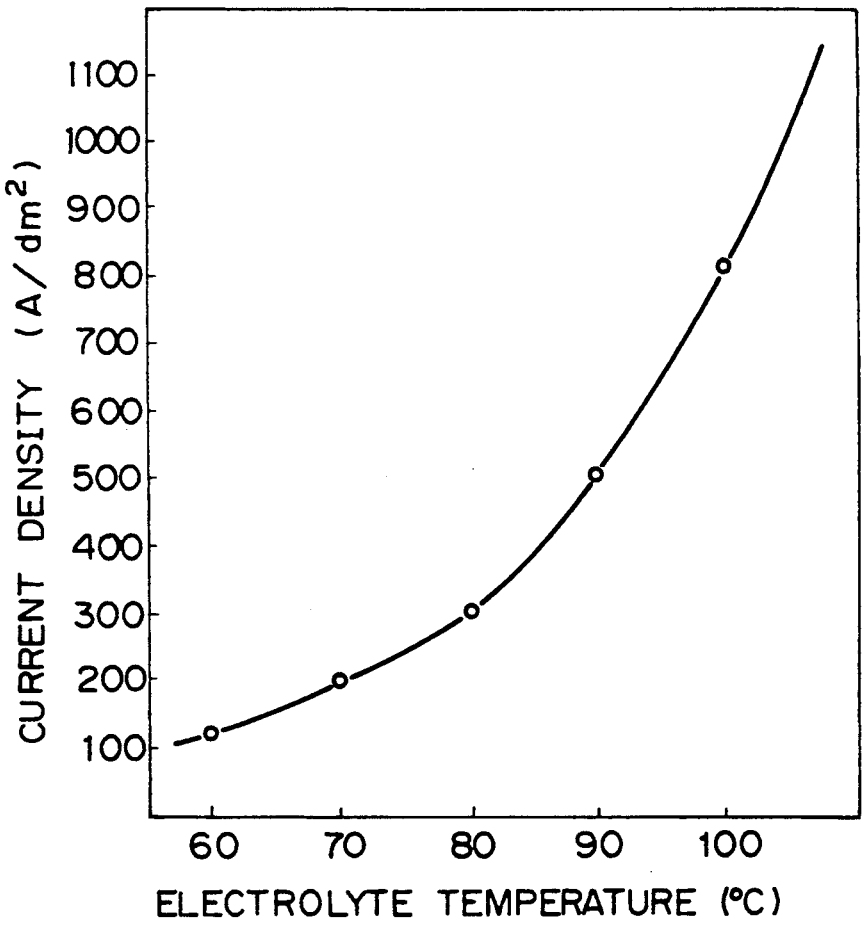
FIG. 19 is a graph for showing the relationship between the electrolyte temperature and the current density.

FIG. 19 shows the relationship between the electrolyte bath temperature and the maximum current density for normal plating operation. It is clearly seen that the current density increases with raise in electrolyte bath temperature. As the bath temperature exceeds 70 degrees, the maximum current density exhibits a significant increase. It is thus clear that plating should preferably carried out at a temperature over 70 degrees.

Figure 20:
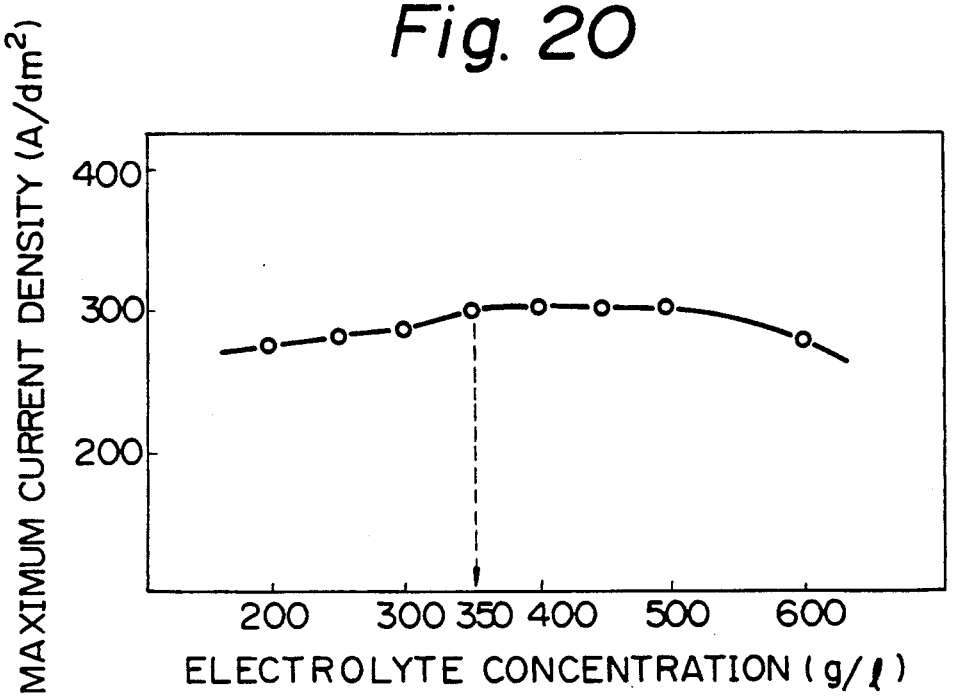
FIG. 20 is a graph for showing the relationship between the electrolyte concentration and the maximum current density.

In the above-described equation (1), C is the concentration of the salt added to the electrolyte. The maximum current density increases with increase in concentration. FIG. 20 shows the relationship between the salt concentration and the maximum current density when nickel sulfate is used for the salt. It is seen in the graph that the maximum current density arrives at the peak as the salt density somewhat exceeds 350 g/l. The maximum current density, however, shows slow decay when the concentration exceeds, the value too much.

Figure 21:
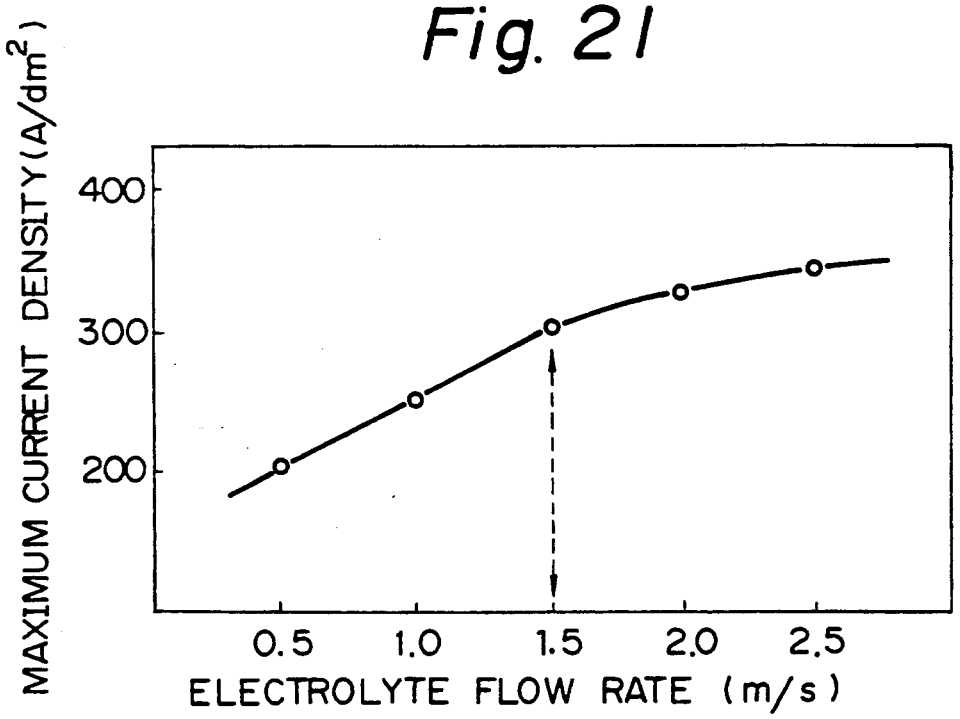
FIG. 21 is a graph for showing the relationship between the electrolyte flow rate and the maximum current density.

In the above-described equation (1), $\delta$ is the thickness of the diffusion layer. The thinner the diffusion layer, the larger the maximum current density and the higher the plating speed. The thickness of the diffusion layer can be reduced by increasing the flow rate of the electrolyte in the area of plating. FIG. 21 shows the relationship between the flow rate and the maximum current density. It is clear from this graph that the higher the flow rate, the larger the maximum current density. This tendency is especially remarkable in the region of the flow rate up to 1.5 m/s. From this result, it is clear that the flow rate of the electrolyte should preferably set higher than 1.5 m/s. Such a high flow rate of the electrolyte, however, requires increased power consumption for forced circulation of the electrolyte and, as a consequence, it is preferable from economic point of view to set the flow rate to a value near 1.5 m/s.

$\alpha$ in the above-described equation (1) is the transport number of metal ions to be plated on the workpieces. The larger the transport number, the larger the maximum current density and the higher the plating speed. In order to increase this transport number, the temperature of the electrolyte bath should preferably raised as in the case of the diffusion coefficient D.

F and n in the equation (1) are the Farady constant and the discharge electron number which are fixed factors.

Figure 22:
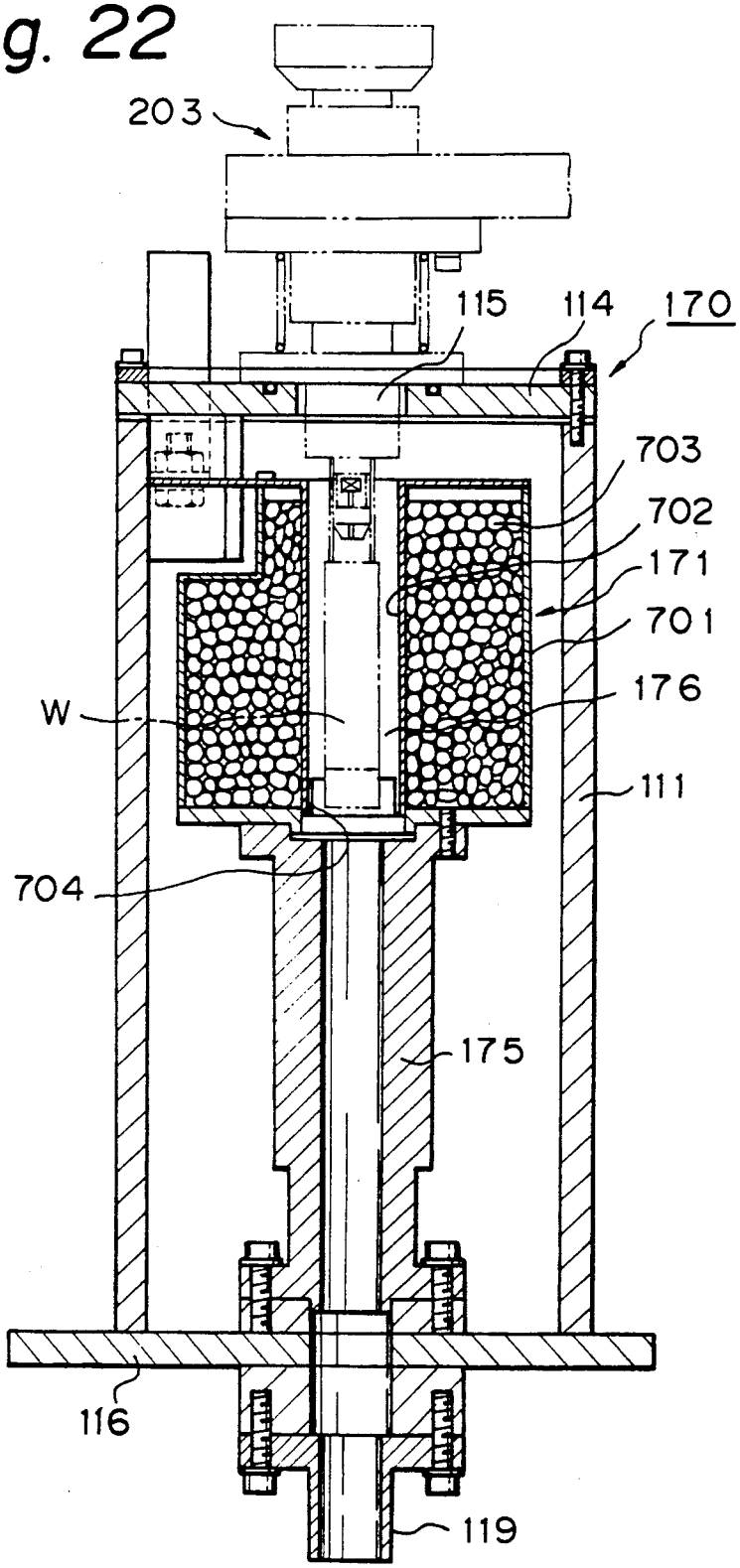
FIGS. 22 to 24 are views of another embodiment of the plating bath unit.
Figure 23:
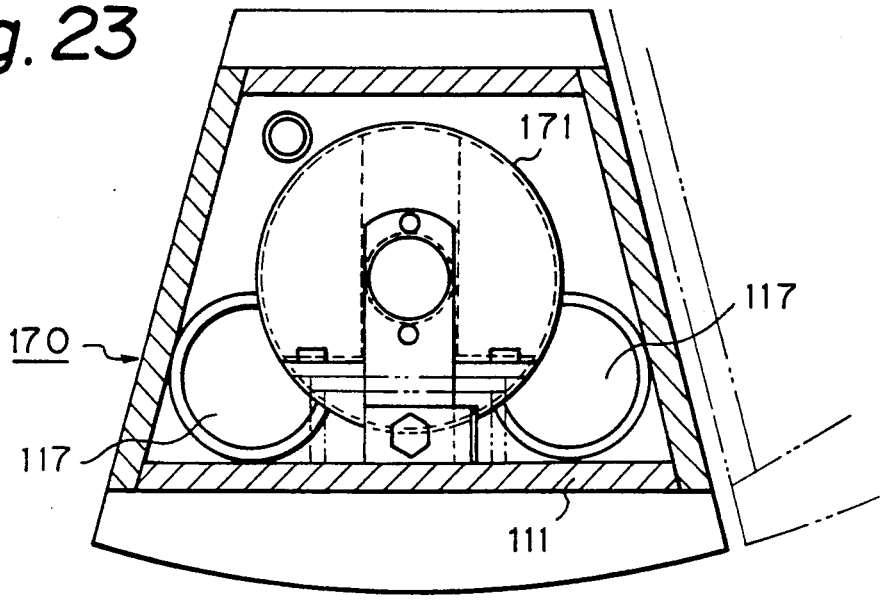
Figure 24:
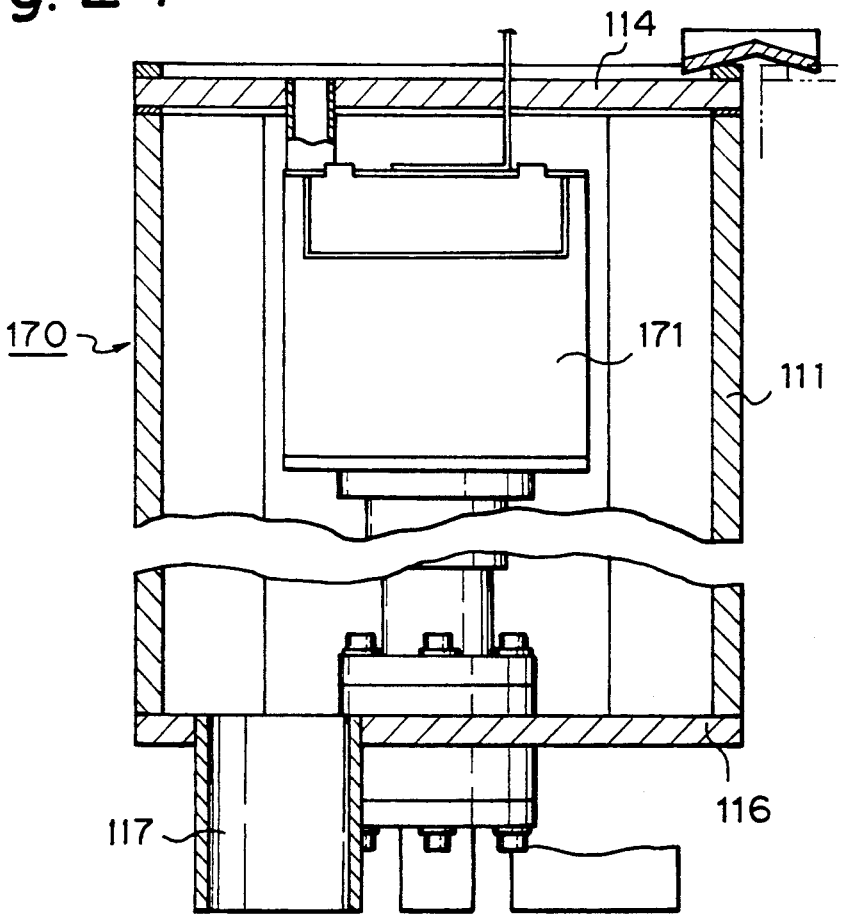

Another embodiment of the plating bath unit 170 in accordance with the present invention is shown in FIGS. 22 to 24. The plating bath unit of this embodiment is different in construction of the bath assembly 171 from that of the first embodiment shown in FIGS. 9 to 11. More specifically, the bath assembly 171 is made up of a casing 701, a network electrode 702 centrally accommodated within the casing 701 and a lot of metal particles 703 filling a space between the casing 701 and the network electrode 702 which define the plaiting bath 176.

The casing 701 is given in the form of a hollow cylinder of a large diameter and preferably made of titanium. The network electrode 702 is a hollow cylinder made of a titanium network. The network electrode 702 is arranged within the casing 701 with its central axis in line with the axis of the lower cylinder 175. The metal particles 703 are made of a metal to be plated on the workpieces. For example, when nickel is to be plated, the particles 703 are made of nickel. The diameter of the particles 703 should preferably be in a range from 5 to 10 mm. The network electrode 702 and the metal particles 703 form positive electrodes during the plating process. A mask collar 704 is attached to the lower end of the plating bath 176 in a manner to cover the lower end of the network electrode 702. When the workpiece to be plated is long enough, the mask collar 704 may be removed.

The plating bath unit 170 of this embodiment operates as follows. As a workpiece W held by the holder assembly 203 of the transfer unit 200 is placed in the plating bath 176 of this plating bath unit 170, electrolyte is supplied from the reservoir 179. The electrolyte fills spaces between the metal particles 703. When the network electrode 702 is galvanized under this condition, the metal particles 703 themselves for positive electrodes. Next, the electric supply head 603 connected to a given negative electrode is moved downwards for contact with the holder assembly 203 for galvanization of the workpiece W. Then, the metal particles 703 forming positive electrodes start to melt into metal ions and arrive at the surface of the workpiece W passing through the network electrode 702.

Since the network electrode 702 is surrounded by the metal particles 703 in the case of this embodiment, damage of the positive electrode located near the workpiece W can be well prevented. That is, even when the workpiece W unexpectedly hits the network electrode 702 at insertion thereof, the metal particles 703 move to absorb a deformation of the network electrode 702. As a result, damage of the positive electrodes made up of the network electrode 702 and the metal particles 703 can be prevented. This greatly stabilizes the quality of plating. In addition, presence of metal particles 703 made of a metal same as that used for plating assures continued supply of the plating metal into the electrolyte. In addition, occasional use of the mask collar 704 makes the plating bath unit 170 suited for processing of workpieces of different lengths.

We claim:

1. An improved metal plating apparatus comprising an electric circuit for galvanizing workpieces during plating, a plurality of treatment bath units arranged along a horizontal arcuate path at substantially equal intervals, said treatment bath units includes a defat bath unit comprising a vertical outer casing, an inner cylinder accommodated in said outer casing and an electrode inserted into said inner cylinder and electrically connected to said electric circuit, said inner cylinder is provided with a top opening for insertion of each said workpiece and a bottom opening for reception of a liquid to be used therein for treatment of said workpiece, a transfer unit arranged at the center of said arcuate path in an arrangement horizontally rotatable about said center and shiftable vertically, said transfer unit including a plurality of holder assemblies for workpieces, the number of said plurality of holder assemblies being at least equal to the number of said plurality of treatment bath units, adjacent ones of said plurlity of holder assemblies being spaced from each other by a distance equal to said intervals between said plurality of treatment bath units, a loading unit arranged facing said transfer unit adjacent to one end of said arcuate path for supply of said workpieces to said transfer unit, and an unloading unit arranged facing said transfer unit adjacent to the other end of said arcuate path for discharge of said workpieces from said transfer unit, whereby different workpieces are concurrently subjected to different sequential treatments in different ones of said plurality of treatment bath units.

2. An improved metal plating apparatus comprising an electric circuit for galvanizing workpieces during plating, a plurality of treatment bath units arranged along a horizontal arcuate path at substantially equal intervals, said plurality of treatment bath units includes a plating bath unit comprising a vertical outer casing, cylinder means comprising upper and lower cylinders accommodated in said outer casing, and electrode means comprising upper and lower electrodes inserted into said upper and lower cylinders and connected to said electric circuit, said upper cylinder being provided with a top opening for insertion of said workpiece said lower cylinder being provided with a bottom opening for reception of a liquid to be used therein for treatment of said workpiece, a transfer unit arranged at the center of said arcuate path in an arrangement horizontally rotatable about said center and shiftable vertically, said transfer unit including a plurality of holder assemblies for workpieces, the number of said plurality of holder assemblies being at least equal to the number of said plurality of treatment bath units, adjacent ones of said plurality of holder assemblies being spaced from each other by a distance equal to said intervals between said plurality of treatment bath units, a loading unit arranged facing said transfer unit adjacent to one end of said arcuate path for supply of said workpieces to said transfer unit, and an unloading unit arranged facing said transfer unit adjacent to the other end of said arcuate path for discharge of said workpieces from said transfer unit, whereby different workpieces are concurrently subjected to different sequential treatments in different ones of said plurality of treatment bath units.

3. An improved metal plating apparatus comprising an electric circuit for galvanizing workpieces during plating, a plurality of treatment bath units arranged along a horizontal arcuate path at substantially equal intervals, said plurality of treatment bath units includes a plating bath unit comprising an outer casing, an inner casing concentrically accommodated in said outer casing, a network electrode centrally accommodated in said inner casing and electrically connected to said electric circuit an metal particles disposed between said inner casing and said network electrode, a transfer unit arranged at the center of said arcuate path in an arrangement horizontally rotatable about said center and shiftable vertically, said transfer unit including a plurality of holder assemblies for workpieces, the number of said plurality of holder assemblies being at least equal to the number of said plurality of treatment bath units, adjacent ones of said plurality of holder assemblies being spaced from each other by a distance equal to said intervals between said plurality of treatment bath units, a loading unit arranged facing said transfer unit adjacent to one end of said arcuate path for supply of said workpieces to said transfer unit and an unloading unit arranged facing said transfer unit adjacent to the other end of said arcuate path for discharge of said workpieces from said transfer unit, whereby different workpieces are concurrently subjected to different sequential treatments in different ones of said plurality of treatment bath units.

4. An improved metal plating apparatus comprising a plurality of treatment bath units arranged along an arcuate path, each of said plurality of treatment bath units including a vertical outer casing, and an inner cylinder accommodated in said outer casing, said inner cylinder being provided with a top opening for insertion of workpieces and a bottom opening for reception of a liquid to be used therein for treatment of said workpieces, a transfer unit arranged at the center of said arcuate path in an arrangement rotatable about said center and shiftable vertically, said transfer unit including an electric circuit for galvanizing workpieces during plating, a loading unit arranged facing said transfer unit adjacent to one end of said arcuate path for supply of said workpieces to said transfer unit and an unloading unit arranged facing said transfer unit adjacent to the other end of said arcuate path for discharge of said workpieces from said transfer unit.

5. An improved metal plating apparatus comprising an electric circuit for galvanizing workpieces during plating, a plurality of treatment bath units arranged along an arcuate path, said plurality of treatment bath units including a defat bath unit comprising a vertical outer casing, an inner cylinder accommodated in said outer casing and an electrode inserted into said inner cylinder, and electrically connected to said electric circuit, said inner cylinder being provided with a top opening for insertion of workpieces and a bottom opening for reception of a liquid to be used therein for treatment of said workpieces, a transfer unit arranged at the center of said arcuate path in an arrangement rotatable about said center and shiftable vertically, a loading unit arranged facing said transfer unit adjacent to one end of said arcuate path for supply of said workpieces to said transfer unit and an unloading unit arranged facing said transfer unit adjacent to the other end of said arcuate path for discharge of said workpieces from said transfer unit.

6. An improved metal plating apparatus comprising an electric circuit for galvanizing workpieces during plating, a plurality of treatment bath units arranged along an arcuate path, said plurality of treatment bath units including a plating bath comprising a vertical outer casing cylinder means comprising upper and lower cylinders accommodated in said outer casing, and electrode means comprising upper and lower electrodes inserted into said pair of upper and lower cylinders and electrically connected to said electric circuit, said upper cylinder being provided with a top opening for insertion of workpieces and said lower cylinder being provided with a bottom opening for reception of a liquid to be used therein for treatment of said workpieces, a transfer unit arranged at the center of said arcuate path in an arrangement rotatable about said center and shiftable vertically, a loading unit arranged facing said transfer unit adjacent to one end of said arcuate path for supply of said workpieces to said transfer unit and an unloading unit arranged facing said transfer unit adjacent to the other end of said arcuate path for discharge of said workpieces from said transfer unit.

7. An improved metal plating apparatus comprising an electric circuit for galvanizing workpieces during plating, a plurality of treatment bath units arranged along an arcuate path, said treatment bath units including a plating bath unit comprising an outer casing, an inner casing concentrically disposed within said outer casing, a network electrode centrally disposed in said inner casing, and electrically connected to said electric circuit, and metal particles disposed between said inner casing and said network electrode, said inner casing being provided with a top opening for insertion of workpieces and a bottom opening for reception of a liquid to be used therein for treatment of said workpieces, a transfer unit arranged at the center of said arcuate path in an arrangement rotatable about said center and shiftable vertically, a loading unit arranged facing said transfer unit adjacent to one end of said arcuate path for supply of said workpieces to said transfer unit and an unloading unit arranged facing said transfer unit adjacent to the other end of said arcuate path for discharge of said workpieces from said transfer unit.

8. An improved metal plating apparatus comprising an electric circuit for galvanizing workpieces during plating, a plurality of treatment bath units arranged along a horizontal arcuate path at substantially equal intervals, said plurality of treatment bath units including a defat bath unit comprising a vertical outer casing, an inner cylinder accommodated in said outer casing and an electrode inserted into said inner cylinder and electrically connected to said electric circuit, said inner cylinder being provided with a top opening for insertion of each said workpiece and a bottom opening for reception of a liquid to be used therein for treatment of said workpiece, a transfer unit arranged at the center of said arcuate path in an arrangement horizontally rotatable about said center and shiftable vertically, said transfer unit including a plurality of holder assemblies for workpieces, the number of said plurality of holder assemblies being at least equal to the number of said plurality of treatment bath units, adjacent ones of said plurality of holder assemblies being spaced from each other by a distance equal to said intervals between said plurality of treatment bath units, and said transfer unit including an electric circuit for galvanzing said workpieces during plating, a loading unit arranged facing said transfer unit adjacent to one end of said arcuate path for supply of said workpieces to said transfer unit and an unloading unit arranged facing said transfer unit adjacent to the other end of said arcuate path for discharge of said workpieces from said transfer unit, whereby different workpieces are concurrently subjected to different sequential treatments in different ones of said plurality of treatment bath units.

9. An improved metal plating apparatus comprising an electric circuit for galvanizing workpieces during plating, a plurality of treatment bath units arranged along a horizontal arcuate path at substantially equal intervals, said plurality of treatment bath units including a plating bath unit comprising a vertical outer casing, cylinder means comprising upper and lower cylinders accommodated in said outer casing, and electrode means comprising upper and lower electrodes inserted into said upper and lower cylinders and electrically connected to said electric circuit, said upper cylinder being provided with a top opening for insertion of said workpiece and said lower cylinder being provided with a bottom opening for reception of a liquid to be used therein for treatment of said workpiece, a transfer unit arranged at the center of said arcuate path in an arrangement horizontally rotatable about said center and shiftable vertically, said transfer unit including a plurality of holder assemblies for workpieces, the number of said plurality of holder assemblies being at least equal to the number of said plurality of treatment bath units, adjacent ones of said plurality of holder assemblies being spaced from each other by a distance equal to said intervals between said plurality of treatment bath units, and said transfer unit including an electric circuit for galvanizing said workpieces during plating, a loading unit arranged facing said transfer unit adjacent to one end of said arcuate path for supply of said workpieces to said transfer unit and an unloading unit arranged facing said transfer unit adjacent to the other end of said arcuate path for discharge of said workpieces from said transfer unit, whereby different workpieces are concurrently subjected to different sequential treatments in different ones of said plurality of treatment bath units.

10. An improved metal plating apparatus comprising an electric circuit for galvanizing workpieces during plating, a plurality of treatment bath units arranged along a horizontal arcuate path at substantially equal intervals, said plurality of treatment bath units including a plating bath unit comprising an outer casing, an inner casing concentrically accommodated in said outer casing, a network electrode centrally accommodated in said inner casing and electrically connected to said electric circuit and metal particles disposed between said inner casing and said network electrode, a transfer unit arranged at the center of said arcuate path in an arrangement horizontally rotatable about said center and shiftable vertically, said transfer unit including a plurality of holder assemblies for workpieces, the number of said plurality of holder assemblies being at least equal to the number of said plurality of treatment bath units, adjacent ones of said plurality of holder assemblies being spaced from each other by a distance equal to said intervals between said plurality of treatment bath units, and said transfer unit including an electric circuit for galvanizing said workpieces during plating, a loading unit arranged facing said transfer unit adjacent to one end of said arcuate path for supply of said workpieces to said transfer unit and an unloading unit arranged facing said transfer unit adjacent to the other end of said arcuate path for discharge of said workpieces from said transfer unit, whereby different workpieces are concurrently subjected to different sequential treatments in different ones of said plurality of treatment bath units.

11. An improved metal plating apparatus comprising a plurality of treatment bath units arranged along a predetermined path, each of said plurality of treatment bath units including a vertical outer casing and an inner cylinder accommodated in said outer casing, said inner cylinder being provided with a top opening for insertion of workpieces and a bottom opening for reception of a liquid to be used therein for treatment of said workpieces, a transfer unit arranged for movement along the predetermined path of said plurality of treatment bath units and shiftable vertically, said transfer unit including an electric circuit for galvanizing workpieces during plating, a loading unit arranged facing said transfer unit adjacent to one end of said predetermined path for the supply of said workpieces to said transfer unit, and an unloading unit arranged facing said transfer unit adjacent to the other end of said predetermined path for discharge of said workpieces from said transfer unit.

12. An improved metal plating apparatus comprising an electric circuit for galvanizing workpieces during plating, a plurality of treatment bath units arranged along a predetermined path, said plurality of treatment bath units including a defat bath unit comprising a vertical outer casing, an inner cylinder accommodated in said outer casing and an electrode inserted into said inner cylinder and electrically connected to said electric circuit, said inner cylinder being provided with a top opening for insertion of workpieces and a bottom opening for reception of a liquid to be used therein for treatment of said workpieces, a transfer unit arranged for movement along the predetermined path of said plurality of treatment bath units shiftable vertically, a loading unit arranged facing said transfer unit adjacent to one end of said predetermined path for supply of said workpieces to said transfer unit, and an unloading unit arranged facing said transfer unit adjacent to the other end of said predetermined path for discharge of said workpieces from said transfer unit.

13. An improved metal plating apparatus comprising an electric circuit for galvanizing workpieces during plating, a plurality of treatment bath units arranged along a predetermined path, said plurality of treatment bath units including a plating bath comprising a vertical outer casing cylinder means comprising upper and lower cylinders accommodated in said outer casing, and electrode means comprising upper and lower electrodes inserted into said pair of upper and lower cylinders and electrically connected to said electric circuit, said upper cylinder being provided with a top opening for insertion of workpieces and said lower cylinder being provided with a bottom opening for reception of a liquid to be used therein for treatment of said workpieces, a transfer unit arranged for movement along the predetermined path of said plurality of treatment bath units shiftable vertically, a loading unit arranged facing said transfer unit adjacent to one end of said predetermined path for supply of said workpieces to said transfer unit, and an unloading unit arranged facing said transfer unit adjacent to the other end of said predetermined path for discharge of said workpieces from said transfer unit.

14. An improved metal plating apparatus comprising an electric circuit for galvanizing workpieces during plating, a plurality of treatment bath units arranged along a predetermined path, said treatment bath units including a plating bath unit comprising an outer casing, an inner casing concentrically disposed within said outer casing, a network electrode centrally disposed in said inner casing, and electrically connected to said electric circuit, and metal particles disposed between said inner casing and said network electrode, said inner casing being provided with a top opening for insertion of workpieces and a bottom opening for reception of a liquid to be used therein for treatment of said workpieces, a transfer unit arranged for movement along the predetermined path of said plurality of treatment bath units and shiftable vertically, a loading unit arranged facing said transfer unit adjacent to one end of said predetermined path for supply of said workpieces to said transfer unit, and an unloading unit arranged facing said transfer unit adjacent to the other end of said predetermined path for discharge of said workpieces from said transfer unit.

* * * * *

UNITED STATES PATENT AND TRADEMARK OFFICE

CERTIFICATE OF CORRECTION

PATENT NO. : 5,092,975

DATED : March 3, 1992

INVENTOR(S) : Yamamura et al

It is certified that error appears in the above-indentified patent and that said Letters Patent is hereby corrected as shown below:

Column 4, line 19, "12" should read --2--
Column 4, line 22, "lever" should read --level--
Column 4, line 60, "workpiece" should read --workpieces--
Column 5, line 8, "a give" should read --give an--
Column 5, line 12, cancel the number "3"
Column 5, line 14, "201" should read --20L--
Column 5, line 17,"degrees" should read --degrees C--
Column 5, line 21, "201" should read --20L--
Column 5, line 25, "degrees" should read --degrees C--
Column 5, line 29, "401" should read --40L--
Column 5, line 33, "degrees" should read --degrees C--
Column 7, line 9, "degrees" should read --degrees C--
Column 7, line 17, "There" should read --That--
Column 8, line 1, "openings in" should read "openings 133 in--
Column 8, line 2, "rising" should read --rinsing--
Column 8, line 27, "in range" should read --in a range--
Column 8, line 46, "degrees" should read --degrees C--
Column 9, line 25, "plaiting" should read --plating--
Column 9, line 51, "for" should read --form--
Column 11, line 26, "an metal" should read --and metal--

Signed and Sealed this

Twentieth Day of July, 1993

*Attest:*

Michael K. Kirk

MICHAEL K. KIRK

*Attesting Officer*

*Acting Commissioner of Patents and Trademarks*